US011808555B1

(12) United States Patent
Liu et al.

(10) Patent No.: US 11,808,555 B1
(45) Date of Patent: Nov. 7, 2023

(54) HANDHELD INTELLIGENT ELECTRONIC FOUNTAIN DEVICE

(71) Applicant: Liuyang East Coast Electronic Technology Co., Ltd., Changsha (CN)

(72) Inventors: Kaifu Liu, Liuyang (CN); Zhishi Gao, Changsha (CN); Kaihui Liu, Changsha (CN); Hui Yang, Changsha (CN)

(73) Assignee: Liuyang East Coast Electronic Technology Co., Ltd., Changsha (CN)

( * ) Notice: Subject to any disclaimer, the term of this patent is extended or adjusted under 35 U.S.C. 154(b) by 0 days.

(21) Appl. No.: 18/138,569

(22) Filed: Apr. 24, 2023

(30) Foreign Application Priority Data

Mar. 28, 2023 (CN) ..... 202310312058.9

(51) Int. Cl.
*F42B 4/00* (2006.01)

(52) U.S. Cl.
CPC ..... *F42B 4/00* (2013.01)

(58) Field of Classification Search
CPC ..... F42B 4/00; F42B 4/18; A63J 5/02; A63J 5/023
See application file for complete search history.

(56) References Cited

U.S. PATENT DOCUMENTS

| | | | | |
|---|---|---|---|---|
| 10,648,782 | B2 | 5/2020 | Chen | |
| 10,852,105 | B1 | 12/2020 | Xiaowen | |
| 10,948,271 | B1 * | 3/2021 | Xiaowen | F42B 4/20 |
| 2012/0279732 | A1 | 11/2012 | Smith | |
| 2018/0238664 | A1 * | 8/2018 | Chen | F42B 4/26 |

FOREIGN PATENT DOCUMENTS

| | | | | |
|---|---|---|---|---|
| CN | 218238571 U | * | 1/2023 | |
| WO | WO-2019075784 A1 | * | 4/2019 | F42B 4/18 |

* cited by examiner

*Primary Examiner* — Jonathan C Weber
(74) *Attorney, Agent, or Firm* — Georgi Korobanov

(57) ABSTRACT

The present application provides a handheld intelligent electronic fountain device, comprising a housing, a storage bin for storing consumables, a heating component for heating consumables, an ejection tube for ejecting consumables outward, and an air supply component for delivering compressed air into the ejection tube, so as to prompt consumables to be ejected out of the ejection tube. The present application provides a first material guiding tube and a first rotating shalt, a first threaded portion for guiding material is provided at one end of the first rotating shaft, and a second threaded portion is provided at other end of the first rotating shaft, and the second threaded portion is threadedly connected with a first transmission gear.

10 Claims, 12 Drawing Sheets

B–B

B–B

HANDHELD INTELLIGENT ELECTRONIC FOUNTAIN DEVICE

CROSS-REFERENCE TO RELATED APPLICATIONS

This is a U.S. patent application which claims the priority and benefit of Chinese Patent Application Number 202310312058.9, filed on. Mar. 28, 2023, the disclosure of which is incorporated herein by reference in its entirety.

TECHNICAL FIELD

The present application relates to the field of pyrotechnic devices, in particular to a handheld intelligent electronic fountain device.

BACKGROUND

After the end of the COVID-19 epidemic, recreational activities for urban and rural residents began to resume gradually. Setting off fireworks has become the most popular form of entertainment among numerous recreational activities.

However, traditional fireworks have the disadvantages of high flame temperature, environmental pollution, and large smoke, so the setting off site is limited and the setting time is limited. Based on this defect, technicians have developed an electronic fountain device, such as CN210400194U discloses an electronic fountain device, wherein the consumables are made of metal powder with low ignition point and auxiliary materials, which are safer. The consumables do not contain sulfides, and the pollution to the environment is almost negligible, while the combustion smoke is smaller.

Although the electronic fountain device solves the shortcomings of traditional fountain such as high flame temperature, polluting the environment, and large smoke, but due to its large size, it cannot be set off at multiple angles (the consumables will block the ejection tube), so the advantages of traditional fountain that can be set off by hand are also lost, and the user experience is not good.

SUMMARY

Based on this, in view of the problems existing in the current electronic fountain device, it is necessary to provide a handheld intelligent electronic flower fountain device, which can be set off by hand and supports use at various ejecting angles. When the consumables block the ejection tube, it can quickly and in intelligently remove the blockage.

Above-mentioned purpose realizes through following technical solution:

A handheld intelligent electronic fountain device, comprising:

a housing;

a storage bin for storing consumables;

a heating component for heating the consumables;

an ejection tube for ejecting the consumables outward;

an air supply component for delivering compressed air into the ejection tube, so as to prompt the consumables to be ejected out of the ejection tube;

a material guiding component for guiding the consumables in the storage bin into the ejection tube;

a power component for driving the material guiding component to run;

the material guiding component comprises a first material guiding tube and a first rotating shaft, and the first rotating shaft is rotatably connected with the first material guiding tube;

one end of the first rotating shaft is provided with a first threaded portion, and other end of the first rotating shaft is provided with a second threaded portion;

the first threaded portion is arranged inside the first material guiding tube, the second threaded portion is arranged outside the first material guiding tube, and the second threaded portion is threadedly connected with a first transmission gear;

the first transmission gear has a first working mode, and the first working mode is divided into a first stroke and a second stroke;

a rotation direction of the first transmission gear in the first stroke is opposite to a rotation direction in the second stroke;

a rotation direction of the first transmission gear in the second stroke is the same as a delivering rotation direction of the first rotating shaft;

a rotational torque of the first transmission gear in the second stroke is greater than a rotational torque in the first stroke.

In one embodiment, a retaining ring is provided at an end of the first rotating shaft away from the first threaded portion, and an elastic member is sheathed between the retaining ring and the first transmission gear and is arranged on outer periphery of the first rotating shaft.

In one embodiment, the ejection tube is vertically arranged vertically relative to the first material guiding tube.

In one embodiment, the material guiding component further comprises a second material guiding tube and a second rotating shaft, and the second material guiding tube is rotatable connected to the second rotating shaft;

an outer periphery of the second rotating shaft is provided with a third threaded portion, and the third threaded portion is arranged in the second material guiding tube;

an end of the second rotating shaft away from the third threaded portion is spline-connected with a second transmission gear;

the second transmission gear has a first working mode and a second working mode;

wherein in the first working mode, the first transmission gear is separated from the second transmission gear;

wherein in the second working mode, the first transmission gear meshes with the second transmission gear.

In one embodiment, the material guiding component further comprises a top ring, which is fixedly arranged on a surface of the second transmission gear close to the retaining ring;

slanting blocks are arranged on circumference of the second rotating shaft, and the slanting block has two triangular sides and an arc-shaped curved surface, and the arc-shaped curved surface is located between the two triangular sides;

the arc-shaped curved surface has two lowest points and a first highest point;

an inner wall of the second transmission gear is provided with a stepped hole, and a ball stud is slidably connected to the stepped hole, a non-ball end of the ball stud is fixedly connected with a reset compression spring, and an end of the reset compression spring away from the ball stud is fixedly connected with a fixing ring, the fixing ring is fixedly arranged at bottom of the stepped hole.

In one embodiment, a control post is fixedly connected to center of the second transmission gear close to the top ring.

In one embodiment, an end of the first rotating shaft close to the second threaded portion is threadedly connected with a bolt, and an outer end surface of the bolt is provided with either a slot or a cross groove.

In one embodiment, the air supply component comprises a fan, and the fan is arranged at an end of the ejection tube away from a discharge direction of the consumables.

In one embodiment, the power component comprises a drive motor and a third transmission gear, the third transmission gear is fixedly connected to an output shaft of the drive motor, and the third transmission gear meshes with the first transmission gear.

In one embodiment, rechargeable batteries are arranged inside the housing.

Beneficial Effects of the Present Application

The present application provides a first material guiding tube and a first rotating shaft, a first threaded portion for guiding material is provided at one end of the first rotating shaft, and a second threaded portion is provided at other end of the first rotating shaft, and the second threaded portion is threadedly connected with a first transmission gear. When the nozzle of the first material guiding tube is blocked by consumables, the first transmission gear first moves away from the nozzle of the first material guiding tube, and then accelerates to rotate and move closer to the nozzle of the first material guiding tube, so as to drive the first rotating shaft with a torque greater than the maximum output torque of a drive motor. Through multiple cycles, the first rotating shaft is released from the stuck state, so as to achieve the effect of quickly and intelligently releasing the blockage.

Figure 1:
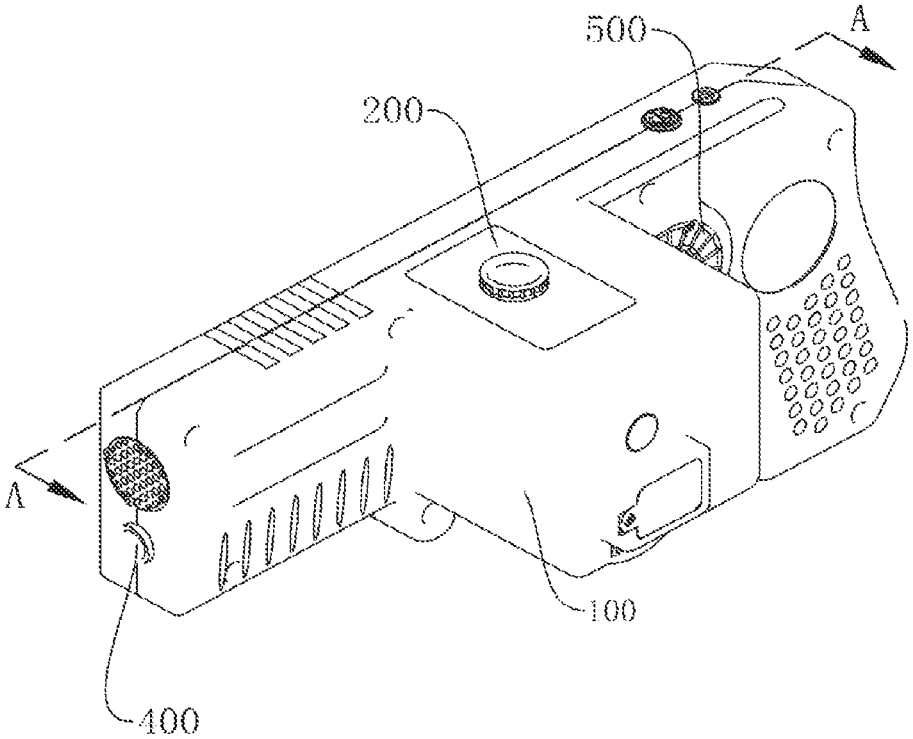
FIG. 1 is an overall structural schematic diagram of the handheld intelligent electronic fountain device according to the present application.

Reference signs: 100. Housing; 110. Maintenance opening; 120. Intermediate material guiding tube; 200. Storage bin; 300. Heating component; 400. Ejection tube; 500. Air supply component; 510. Fan; 600. Material guiding component; 610. 620. First rotating shaft; 621. First threaded portion; 622. Second threaded portion; 623. Bolt; 624. Shaft shoulder; 630. First transmission gear; 640. Retaining ring; 650. Elastic member; 660. Second material guiding tube; 670, Second shaft; 671. Third threaded portion; 672. Slanting block; 673. Spline block; 680. Second transmission gear; Rod; 683. Reset compression spring; 684. Fixing ring; 685. Control post; 686. Spline groove; 690. Top ring; 700. Power component; 710. Drive motor; 720. Third transmission gear; 810. Main board; 820. Rechargeable battery; 830. Power switch; 840. Control switch; 850. Relay.

DETAILED DESCRIPTION

In order to make the purpose, technical solution and advantages of the present application clearer, the present application will be further described in detail through the following embodiments and in conjunction with the accompanying drawings. It should be understood that the specific embodiments described here are only used to explain the present application, not to limit the present application.

The serial numbers assigned to the components in this document, such as "first", "second", etc., are only used to distinguish the described objects and do not have any sequence or technical meaning. The "connection" and "couple" mentioned in this application include direct and indirect connection (couple) unless otherwise specified. In the description of this application, it should be understood that the orientation or positional relationship indicated by the terms "upper", "lower", "front", "rear", "left", "right", "vertical", "horizontal.", "top", "bottom", "inner", "outer", "clockwise", "counterclockwise", etc. is based on the orientation or positional relationship shown in the drawings, and is only for the convenience of describing the present application and simplifying the description, rather than indicating or implying that the device or element referred to must have a particular orientation, be constructed and operate in a particular orientation, and thus should not be construed as limiting the application.

In the present application, unless otherwise clearly specified and limited, a first feature being "on" or "under" a second feature may mean that the first and second features are in direct contact, or that the first and second features are indirect contact through an intermediary. The first feature is "above", "on" the second feature may mean that the first feature is directly above or obliquely above the second feature, or simply means that the level of the first feature is higher than the second feature. The first feature is "under", "below" the second feature may mean that the first feature is directly below or obliquely under the second feature, or simply means that the first feature has a lower level than the second feature.

Figure 2:
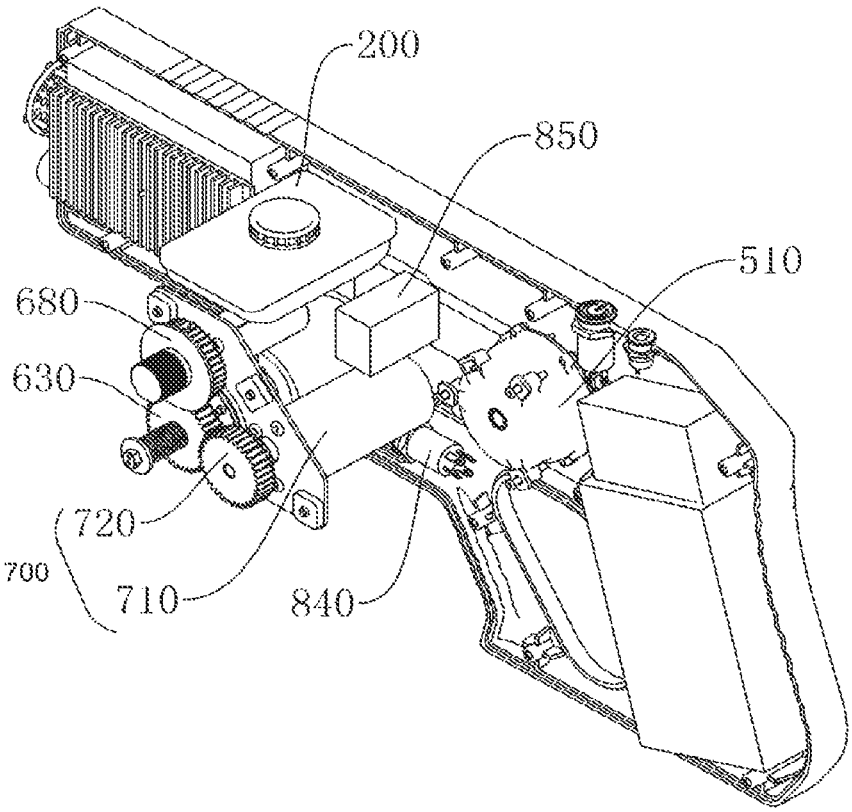
FIG. 2 is a schematic diagram of an internal structure of the housing of the handheld intelligent electronic fountain device according to the present application in the first direction.

As shown in FIGS. 1-14, a handheld intelligent electronic fountain device comprises: a housing 100, the housing 100 is shaped like a toy pistol, which is convenient for users to hold and has a better entertainment experience;

a storage bin 200, the storage bin 200 is used to store consumables, and the consumables are made by mixing metal powder with low ignition point and auxiliary materials;

a heating component 300, the heating component 300 is used to heat the consumables, the heating component 300 can be a heater in a thermal resistance type, or can be heated by an eddy current heater;

an ejection tube 400, which is used to eject the consumables outward, the inner wall of the ejection tube 400 is coated with a heat-resistant coating, and the outer wall of the ejection tube 400 is coated with a heat insulating layer, so as to prevent the user from feeling uncomfortable due to the increase of the surface temperature of the housing 100;

an air supply component 500, which is used to deliver compressed air into the ejection tube 400 to prompt the consumables to be ejected out of the ejection tube 400, the air supply component 500 comprises a fan 510. The fan 510 is arranged at one end of the ejection tube 400 away from the discharge direction of consumables. The air supply component 500 also comprises an air supply tube. In the ejection tube 400, the consumables are ejected from the ejection tube 400 by compressed air;

a material guiding component 600, which is used to guide the consumables in the storage bin 200 into the Ejection tube 400;

a power component 700, the power component 700 is used to drive the material guiding component 600 to run. As shown in FIG. 2, the power component 700 comprises a drive motor 710 and a third transmission gear 720, the third transmission gear 720 is fixedly connected to the output shaft of the drive motor 710, and the third transmission gear 720 meshes with the first transmission gear 630. The drive motor 710 could be a direct drive motor, which is low in cost and convenient for mass production and sale.

Figure 7:
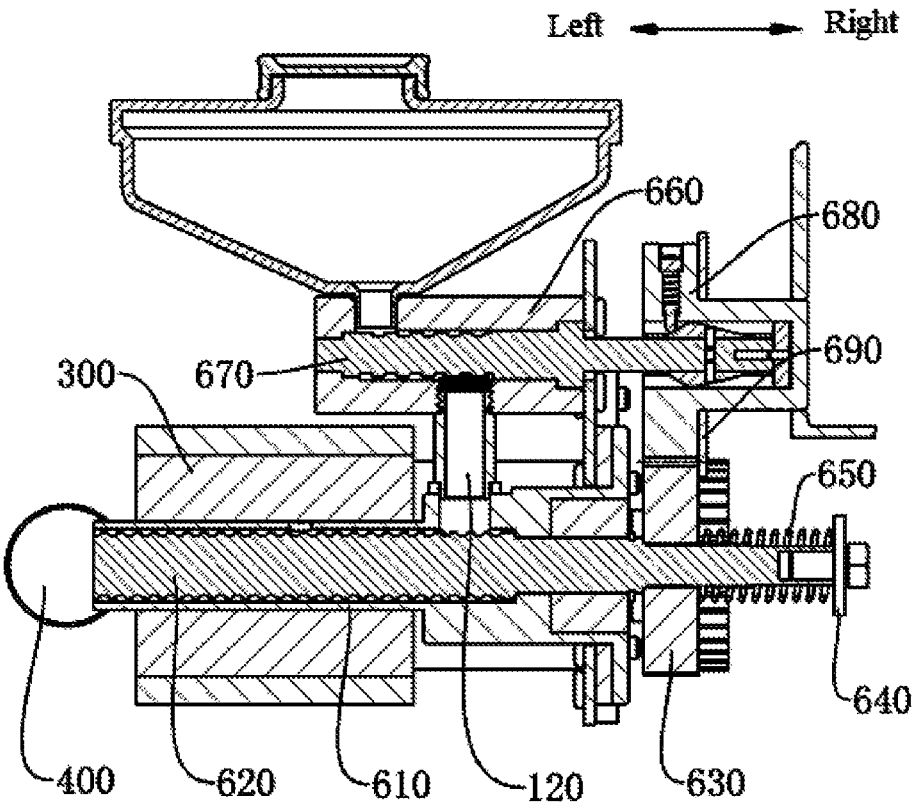
FIG. 7 is a schematic diagram of B-B sectional view in FIG. 6.
Figure 8:
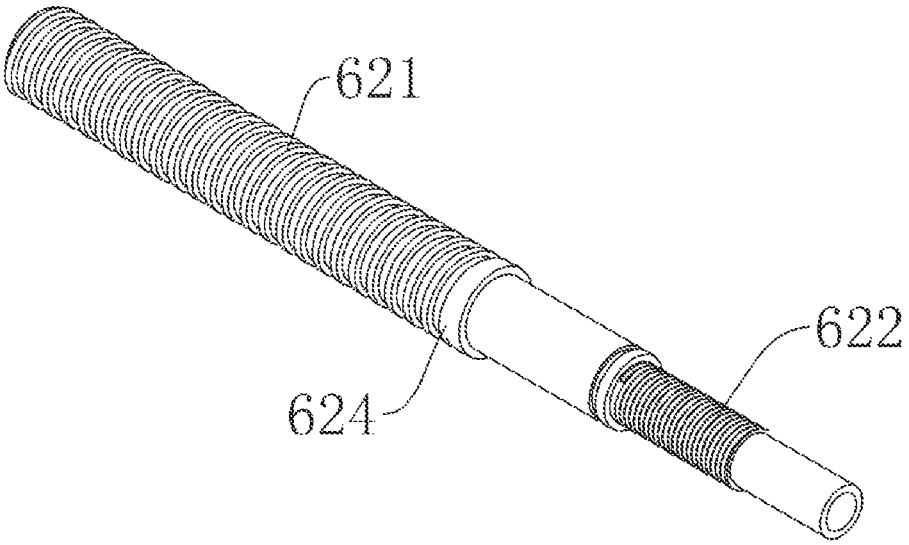
FIG. 8 is a structural schematic diagram of the first rotating shaft in the handheld intelligent electronic fountain device according to the present application.

As shown in FIG. 7, the material guiding component 600 comprises a first material guiding tube 610 and a first rotating shaft 620, the first material guiding tube 610 is fixedly arranged inside the housing 100, and the first rotating shaft 620 is rotationally connected with the first material guiding tube 610;

one end of the first rotating shaft 620 is provided with a first threaded portion 621, and other end of the first rotating shaft 620 is provided with a second threaded portion 622; the first threaded portion 621 is a thread groove or a dragon thread piece, and the thread groove or a dragon thread piece is in close contact with the inner wall of the first material guiding tube 610, so that the powdery consumables can be transported forward by the first threaded portion 621 under the action of friction between it and the inner wall of the first material guiding tube 610;

the first threaded portion 621 is arranged inside the first material guiding tube 610, the second threaded portion 622 is arranged outside the first material guiding tube 610, and the second threaded portion 622 is threadedly connected with a first transmission gear 630, wherein the second threaded portion 622 is a transmission thread;

the first transmission gear 630 has a first working mode, and the first working mode is divided into a first stroke and a second stroke. As shown in FIG. 7, the direction of the first stroke is the direction in which the first transmission gear 630 moves toward the retaining ring 640 along the second threaded portion 622, and the direction of the second stroke is the direction in which the first transmission gear 630 moves along the second threaded portion 622 away from the retaining ring 640; Therefore, the rotation direction of the first transmission gear 630 in the first stroke is opposite to the rotation direction of the second stroke, and the first transmission gear 630 all moves from one end of the second threaded portion 622 to the other end, so the distance values of the first trip and the second trip are the same.

When the first transmission gear 630 moves to its rightmost end along the second threaded portion 622, the drive motor 710 changes the direction of rotation to drive the first transmission gear 630 to reversely rotate. In order to make the torque that can be obtained when the first transmission gear 630 rotates to the leftmost position of the second threaded portion 622 be greater than the torque value output by the drive motor 710, in this embodiment, the kinetic energy is supplemented to the first transmission gear 630 during the process of the first transmission gear 630 turning to the left end, such as setting an electric push rod on the side of the retaining ring 640 close to the first transmission gear 630, When the first transmission gear 630 rotates to the left end along the second threaded portion 622, the electric push rod pushes the first transmission gear 630 to accelerate to the left end, so that the first transmission gear 630 rotates to the second threaded portion 622. The torque value on the first rotating shaft 620 at the leftmost end can be greater than the torque value output by the drive motor 710;

The rotation direction of the first transmission gear 630 in the second stroke is the same as the delivering rotation direction of the first shaft 620, and the first transmission gear 630 drives the first rotating shaft 620 to rotate by increasing the torque value to the first rotating shaft 620 in the second stroke, to achieve intelligent blockage removal;

The rotational torque of the first transmission gear 630 in the second stroke is greater than the rotational torque in the first stroke. Its function is that when the first transmission gear 630 is rotated to the leftmost position of the second threaded portion 622, the torque value that can be applied to the first rotating shaft 620 is greater than the torque value output by the drive motor 710.

It should be supplemented here that the reason why a high-torque drive member is not used as the drive motor 710 is mainly because the high-torque drive motor 710 has a high cost and is not convenient for mass production and sales when used in entertainment equipment.

Figure 5:
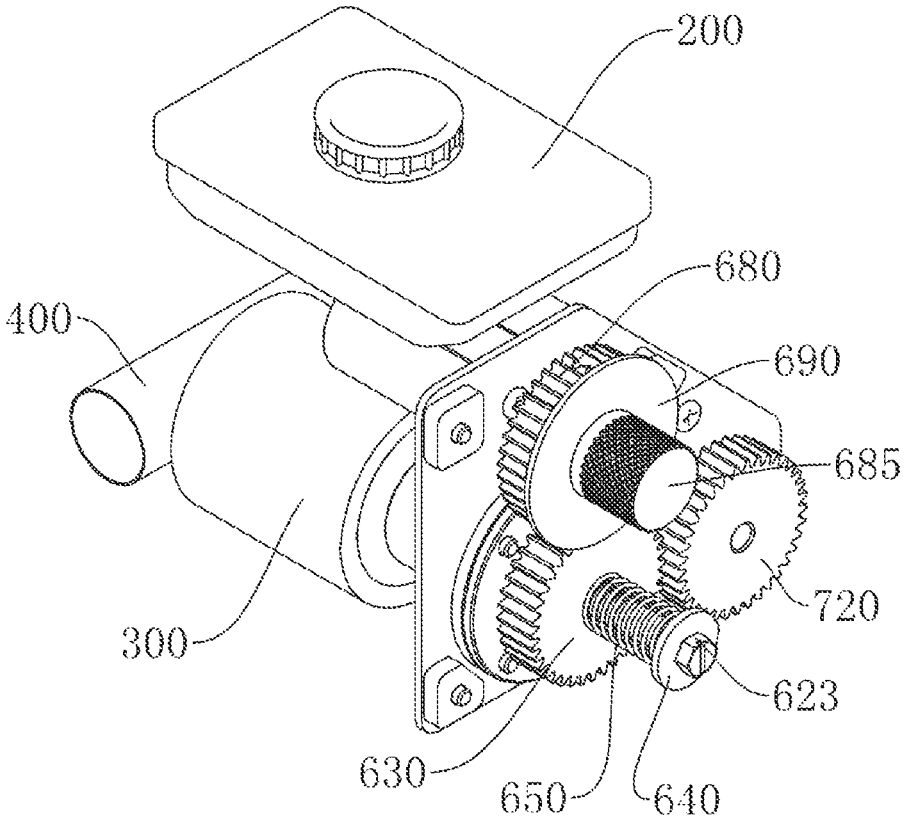
FIG. 5 is a structural schematic diagram of a material guiding component in a handheld intelligent electronic fountain device according to the present application.
Figure 6:
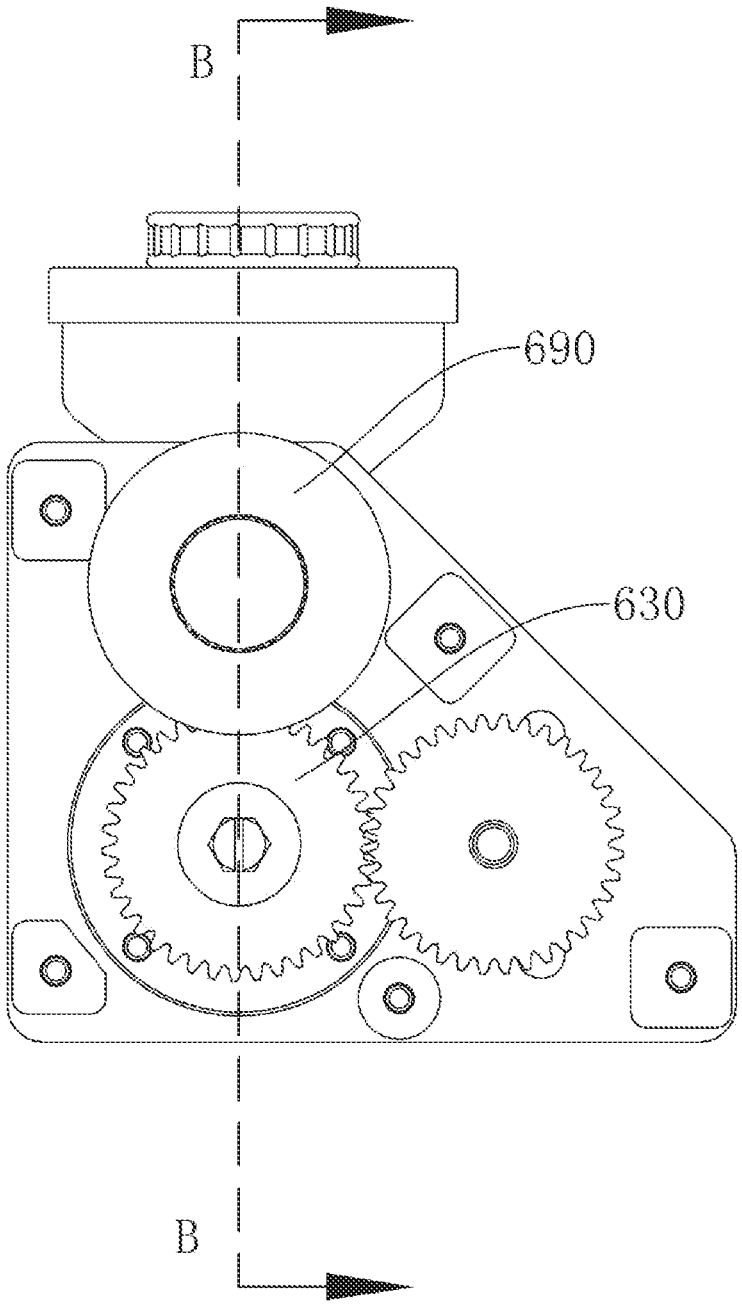
FIG. 6 is a front view structural schematic diagram of FIG. 5.
Figure 9:
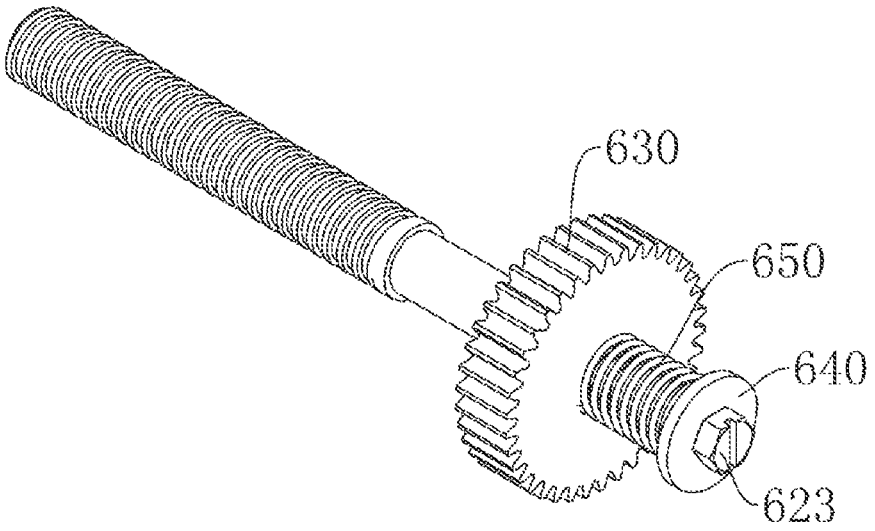
FIG. 9 is a schematic diagram of the connection structure of the first transmission gear in the handheld intelligent electronic fountain device according to the present application.
Figure 10:
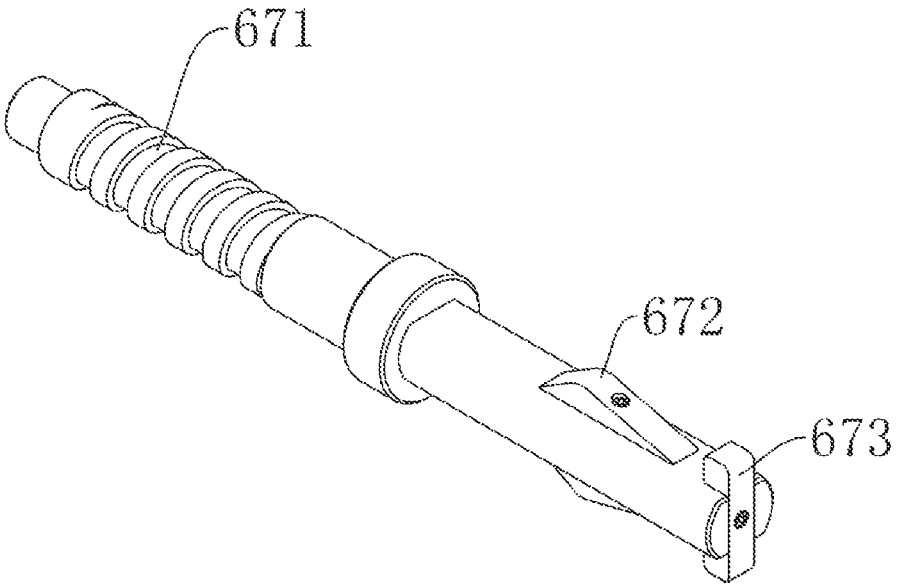
FIG. 10 is a structural schematic diagram of the second rotating shaft in the handheld intelligent electronic fountain device according to the present application.
Figure 11:
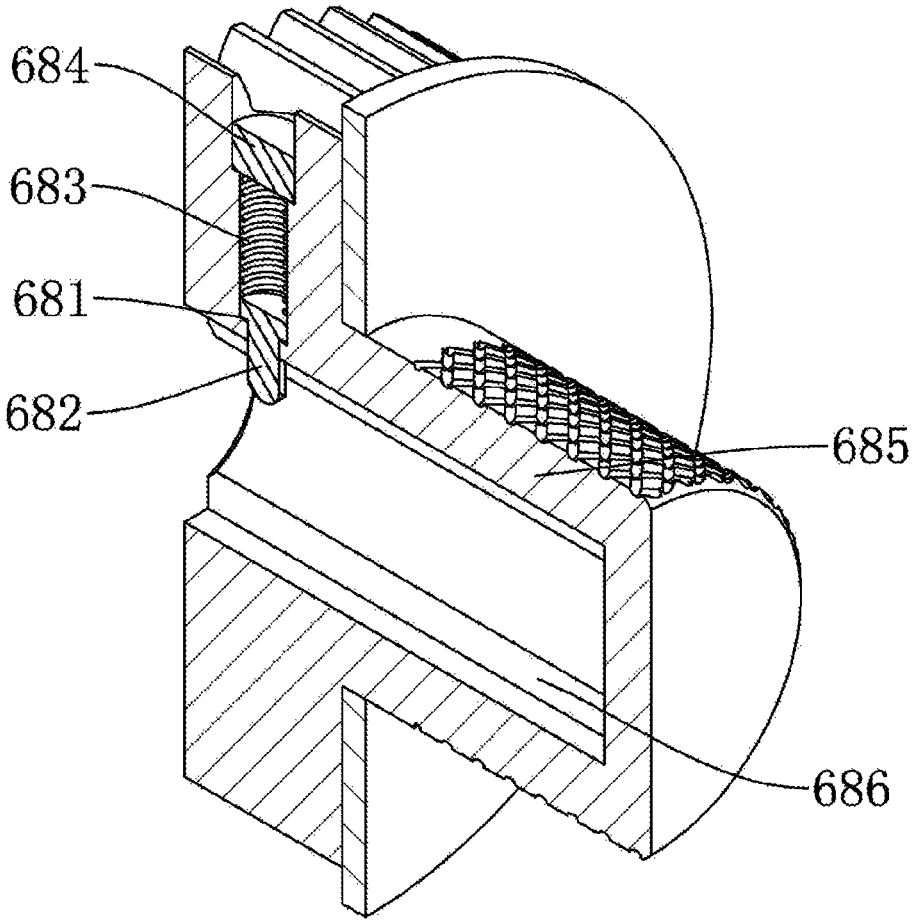
FIG. 11 is a schematic sectional perspective view of the second transmission gear in the handheld intelligent electronic fountain device according to the present application.

In one embodiment, as shown in FIG. 5 and FIG. 9, a retaining ring 640 is provided at an end of the first rotating shaft 620 away from the first threaded portion 621, and an elastic member 650 is sheathed between the retaining ring 640 and the first transmission gear 630 and is arranged on outer periphery of the first rotating shaft 620. The elastic member 650 is specifically any one of a compression spring or a metal elastic sheet. As shown in FIG. 7 and FIG. 9, elastic member 650 could be compression spring, and the main reason is that compression spring is a standard part. During manufacture, compression spring accessories of required specifications can be purchased according to the diameter of the first rotating shaft 620, which can greatly reduce production costs and quickly seize the market. In addition, the compression spring is also used because the compression spring has excellent energy storage and energy release performance.

A shaft shoulder 624 is provided on the outer periphery of the first rotating shaft 620 close to the left end of the second threaded portion 622. When the first transmission gear 630 accelerates to move to the left end position of the second threaded portion 622, the shock generated by the collision between the first transmission gear 630 and the shaft shoulder 624 can also promote loosening of consumables.

Figure 4:
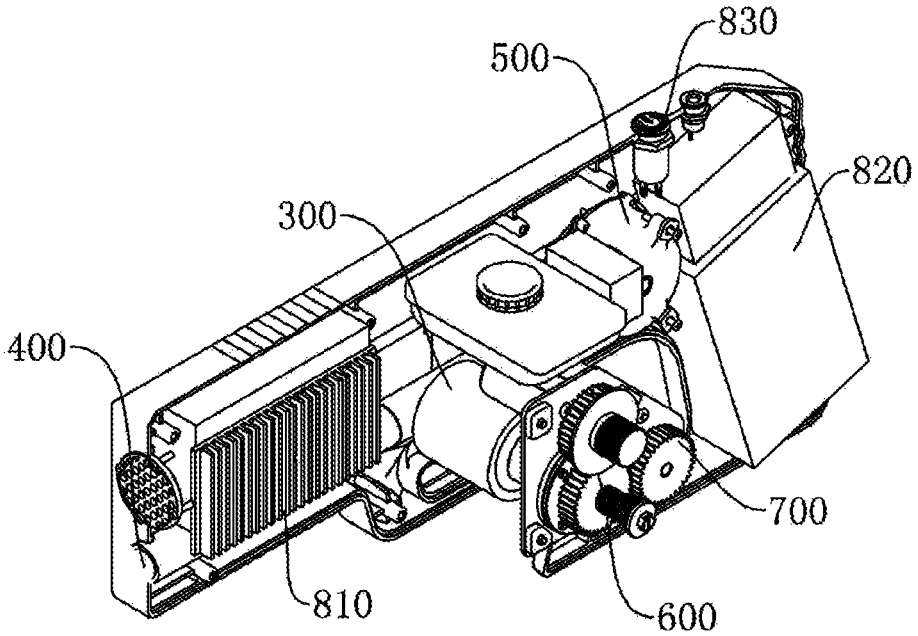
FIG. 4 is a structural schematic diagram of the internal structure of the housing of the handheld intelligent electronic fountain device according to the present application in the second direction.

As shown in FIGS. 2 and 4, a main board 810, a rechargeable battery 820, a power switch 830, a control switch 840 and a relay 850 are arranged outside the housing 100. A charging port for connecting the rechargeable battery 820 is provided outside the housing 100. After the charger is connected to the charging port and the municipal power supply, the rechargeable battery 820 can be charged When the red light of the charger is on, it indicates that it is charging, and when the green light is on, it indicates that the rechargeable battery 820 is fully charged. In terms of circuit control, only after the power switch 830 is activated, pressing the control switch 840 can drive the fan 510, the heating component 300 and the drive motor 710 inside the housing 100 to operate. The purpose of such setting is to increase the safety of use and prevent young children from accidentally pressing the control switch 840 to cause harm to themselves or others.

During normal use (this is the second working mode), first click the power switch 830, and then press the control switch 840, at this time the consumables are ejected out from the ejection tube 400. When the discharge direction of the first material guiding tube 610 is inclined upward, the discharge speed of the consumables is reduced due to the gravity of the consumables themselves, so the molten consumables may solidify and block the discharge opening of the first material guiding tithe 610.

When consumables are blocked in the nozzle of the first material guide tube 610, the first rotating shall 620 cannot rotate due to the increased resistance, at this time, double-click the power switch 830 to make the drive motor 710 enter the first working mode. The drive motor 710 rotates forward and reverse alternately for a preset duration (the preset duration is the required duration for the drive motor 710 to drive the third transmission gear 720 to rotate from one end of the second threaded portion 622 to the other end). At this time, the drive motor 710 drives the third transmission gear 720 to rotate in reverse, and the third transmission gear 720 drives the first transmission gear 630 to rotate and move to the right end of the first rotating shaft 620 along the second threaded portion 622. Under the action of the pushing pressure of the first transmission gear 630, the compression spring located between the first transmission gear 630 and the retaining ring 640 is compressed, and the elastic potential energy of the compression spring increases. When the first transmission gear 630 moves to the rightmost position of the second threaded portion 622, the drive, motor 710 changes the rotation direction, thereby driving the first transmission gear 630 to move along the second threaded portion 622 to the left end of the first rotating shaft 620. During this process, the elastic potential energy of the compression spring is gradually released and converted into kinetic energy to the first transmission gear 630 (at this time, the torque value of the first transmission gear 630 is the torque value provided by the drive motor 710 and the torque value provided by the compression spring), so that the torque value of the first transmission gear 630 is greater than the torque value output by the drive motor 710, Thus, the first transmission gear 630 can apply a large torque value to the first rotating shaft 620 through the second threaded portion 622 to drive the first rotating shaft 620, and discharge the blockage in the first material guiding tube 610;

If the first rotating shaft 620 is not driven to rotate, the drive motor 710 continues to switch forward and reverse rotation, and the first rotating shaft 620 is released from the stuck state through multiple cycles.

Figure 3:
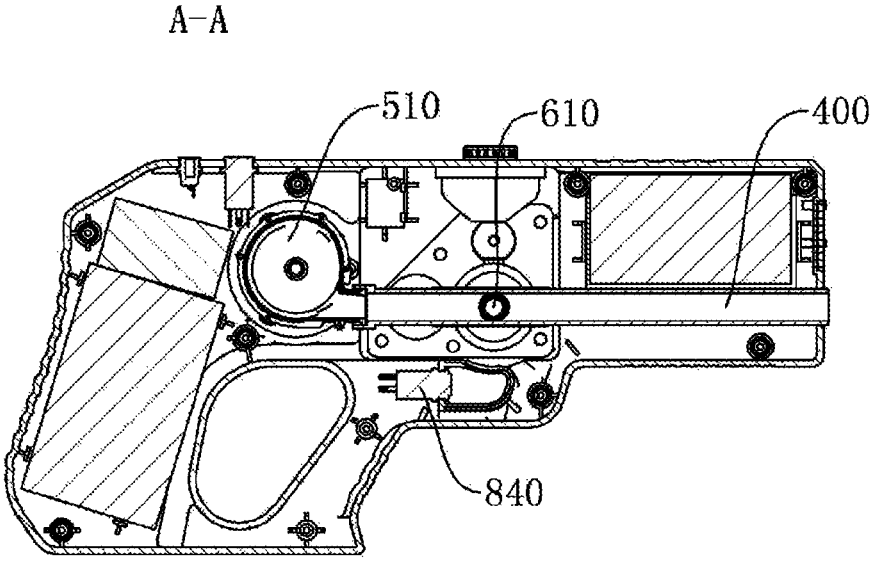
FIG. 3 is a structural schematic diagram of A-A section in FIG. 1.

In one embodiment, as shown in FIG. 3, the ejection tube 400 is vertically arranged relative to the first material guiding tube 610.

The reason why the ejection tube 400 is arranged vertically to the first material guiding tube 610 is that users will use the ejection tube 400 tilted upwards or downwards during use (consistent with the holding posture of most users). The vertical arrangement of the ejection tube 400 and the first material guiding tube 610 will not cause the first material guiding tube 610 to incline due to the inclination of the ejection tube 400 during this process. Therefore, the inclination of the ejection tube 400 has no effect on the discharge fluency of the first material guiding tube 610, and the first material guiding tube 610 can still lead out consumables normally, and the handheld intelligent electronic fountain device can be used normally. This design is ingenious in conception and simple in structure, and can effectively solve the problem of consumables blocking when the ejection tube 400 is tilted.

What needs to be added here is that after the consumables enter the ejection tube 400, due to the action of the fan 510, there is no need to consider the problem that the consumables are blocked in the ejection pipe 400 and cannot be ejected outward.

In one embodiment, as shown in FIG. 7, the material guiding component 600 further comprises a second material guiding tube 660 and a second rotating shaft 670, and the second material guiding tube 660 is rotatably connected to the second rotating shaft 670;

The outer periphery of the second rotating shaft 670 is provided with a third threaded portion 671, and the third threaded portion 671 is located in the second material guiding tube 660;

One end of the second rotating shaft 670 away from the third threaded portion 671 is spline-connected with a second transmission gear 680, and the end of the second transmission gear 680 away from the third threaded portion 671 is provided with a spline block 673, and a spline groove 686 matched with the spline block 673 is provided on the inner wall of the second transmission gear 680;

The second transmission gear 680 has a first working mode and a second working mode;

In the first working mode, the first transmission gear 630 is separated from the second transmission gear 680;

When in the second working mode, the first transmission gear 630 meshes with the second transmission gear 680.

In one embodiment, as shown in FIG. 7-FIG. 11, the material guiding component 600 further comprises a top ring 690, and the top ring 690 is fixedly arranged on a surface of the second transmission gear 680 close to the retaining ring 640;

slanting blocks 672 are arranged on circumference of the second rotating shaft 670, and the slanting block 672 has two triangular sides and an arc-shaped curved surface, and the arc-shaped curved surface is located between the two triangular sides;

the arc-shaped curved surface has two lowest points and a first highest point;

an inner wall of the second transmission gear 680 is provided with a stepped hole 681, and a ball stud 682 is slidably connected to the stepped hole 681, a non-ball end of the ball stud 681 is fixedly connected with a reset compression spring 683, and an end of the reset compression spring 683 away from the ball stud 682 is fixedly connected with a fixing ring 684, the fixing ring 684 is fixedly arranged at bottom of the stepped hole 681.

As shown in FIG. 7, an intermediate material guiding tube 120 is rotatably disposed between the second material guiding tube 660 and the first material guiding tube 610. The intermediate guiding tube 120 is engaged with the third threaded portion 671 on the outside, and is used to feed the consumables conveyed by the third threaded portion 671 into the intermediate guiding tube 120.

Figure 12:
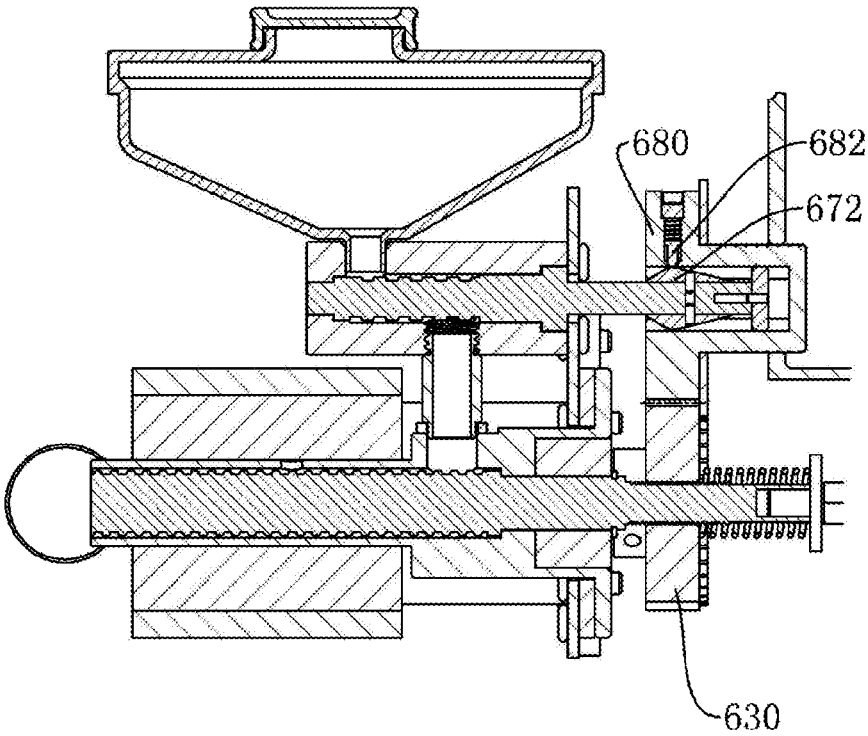
FIG. 12 is a schematic diagram of the first mating state of the first transmission gear and the second transmission gear in the handheld intelligent electronic fountain device according to the present application.
Figure 13:
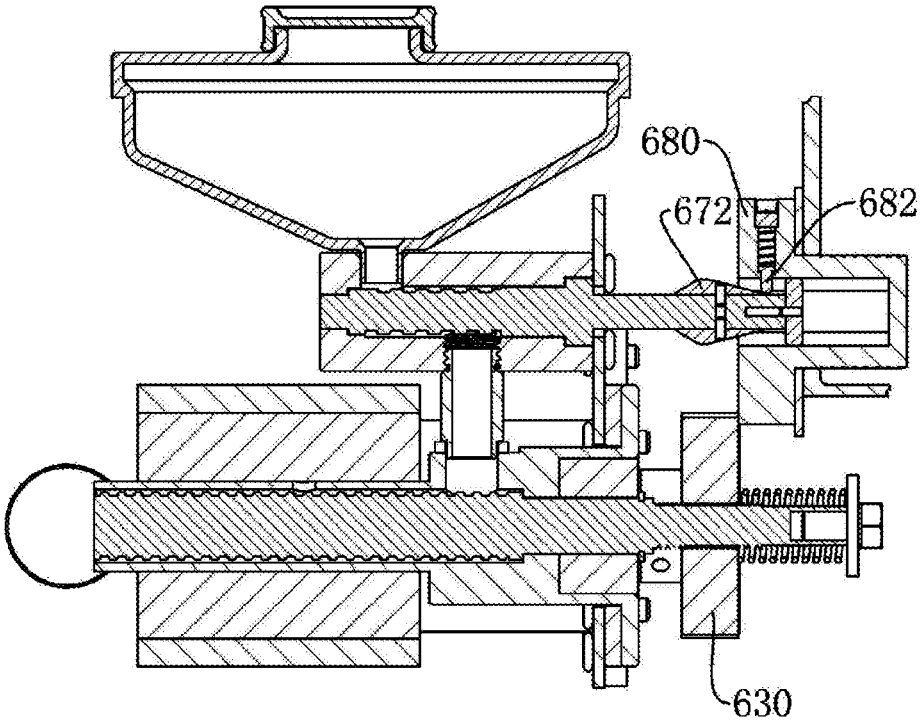
FIG. 13 is a schematic diagram of the second cooperation state of the first transmission gear and the second transmission gear in the handheld intelligent electronic fountain device according to the present application.

During work, when the first transmission gear 630 moves towards the direction close to the retaining ring 640, the first transmission gear 630 pushes the top ring 690 to move to the left end, and the retaining ring 690 drives the second transmission gear 680 to move to the left end, so that the relative position between the ball stud 682 and the slanting block 672 changes from FIG. 12 to FIG. 13. At this time, the ball stud 682 continues to slide a certain distance to the left end along the slope of the slanting block 672 under the pressure of the reset compression spring 683, so that the first transmission gear 630 and the second transmission gear 680 are disengaged. Therefore, during the reciprocating movement of the first transmission gear 630, the first transmission gear 630 does not drive the second transmission gear 680 to rotate, thereby preventing the third threaded portion 671 from transporting consumables from the second material guiding tube 660 to the inside of the first material guiding tube 610, thereby making it easier for the first rotating shaft 620 to be released from being stuck by the consumables.

What needs to be added here is that the reason why consumables block the second material guiding tube 660 is not considered is that the heating component 300 is outside the first material guiding tube 610. If the consumables at the end of the first material guiding tube 610 are not discharged in time, the molten consumables will solidify at the mouth of the first material guiding tube 610, so that blockage will occur, while the consumables in the second material guiding tube 660 are in the form of powder, so no blockage occurs.

Figure 14:
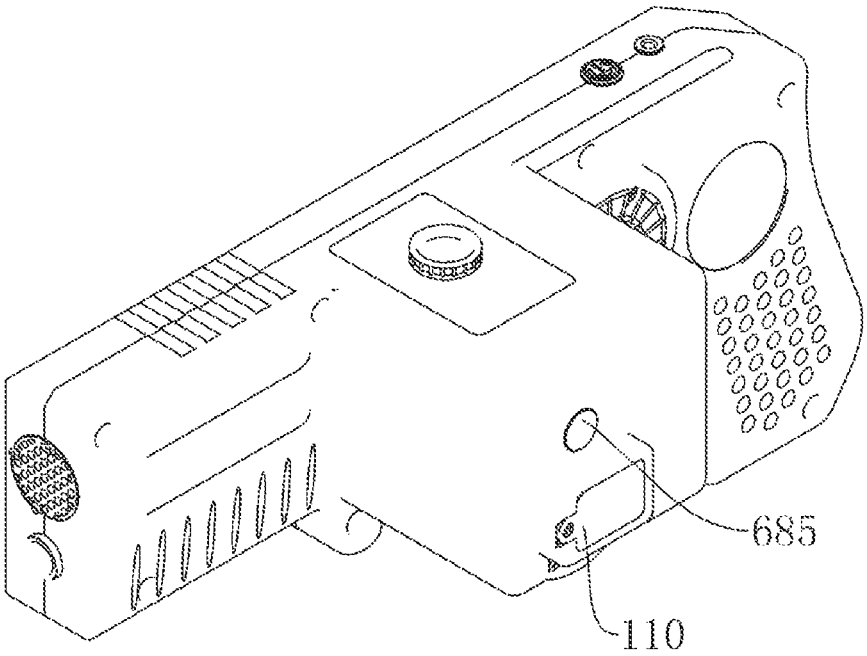
FIG. 14 is a schematic diagram at position of the maintenance opening in the handheld intelligent electronic fountain device according to the present application.

In one embodiment, as shown in FIG. 5 and FIG. 14, a control post 685 is fixedly connected to the center of the second transmission gear 680 close to the top ring 690.

The control post 685 is used to click the power switch 830 again to switch to the second working mode after the first rotating shaft 620 is released from the stuck state. At this time, pushing the control post 685 drives the second transmission gear 680 to move to the right, so that the second transmission gear 680 continues to mesh with the first transmission gear 630, thereby returning to normal material guiding.

In one embodiment, as shown in FIG. 9, one end of the first rotating shaft 620 close to the second threaded portion 622 is threadedly connected with a bolt 623, and the outer end surface of the bolt 623 is provided with either a slot or a cross groove.

When the blockage at the mouth of the first material guiding pipe 610 cannot be discharged through multiple forward and reverse switching rotations of the drive motor 710, a maintenance opening 110 is provided outside the housing 100 at the position of the bolt 623. At this time, the maintenance opening 110 is opened, and the first rotating shaft 620 is forced to rotate by using a screwdriver corresponding to a slotted screwdriver or a Phillips screwdriver to snap into the slotted slot or cross slot outside the bolt 623 to release it from the stuck state.

The technical features of the above embodiments can be combined arbitrarily, and all possible combinations of the technical features of the above embodiments are not described for concise description. However, as long as there is no contradiction in the combination of these technical features, it should be considered as within the scope of the description.

The above-mentioned embodiments only express several implementation modes of the present application, and the description thereof is relatively specific and detailed, but should not be construed as limiting the patent scope of the present application. It should be noted that those skilled in the art can make several modifications and improvements without departing from the concept of the present application, and these all belong to the protection scope of the present application. Therefore, the protection scope of the patent application should be based on the appended claims.

What is claimed is:

1. A handheld intelligent electronic fountain device, comprising:

a housing;

a storage bin for storing consumables;

a heating component for heating the consumables;

an ejection tube for ejecting the consumables outward;

an air supply component for delivering compressed air into the ejection tube, so as to prompt the consumables to be ejected out of the ejection tube;

a material guiding component for guiding the consumables in the storage bin into the ejection tube;

a power component for driving the material guiding component to run;

the material guiding component comprises a first material guiding tube and a first rotating shaft, and the first rotating shaft is rotatably connected with the first material guiding tube;

one end of the first rotating shaft is provided with a first threaded portion, and other end of the first rotating haft is provided with a second threaded portion;

the first threaded portion is arranged inside the first material guiding tube, the second threaded portion is arranged outside the first material guiding tube, and the second threaded portion is threadedly connected with a first transmission gear;

the first transmission gear has a first working mode, and the first working mode is divided into a first stroke and a second stroke;

a rotation direction of the first transmission gear in the first stroke is opposite to a rotation direction in the second stroke;

a rotation direction of the first transmission gear in the second stroke is the same as a delivering rotation direction of the first rotating shaft; and a rotational torque of the first transmission gear in the second stroke is greater than a rotational torque in the first stroke.

2. The handheld intelligent electronic fountain device according to claim 1, wherein a retaining ring is provided at an end of the first rotating shaft away from the first threaded portion, and an elastic member is sheathed between the retaining ring and the first transmission gear and is arranged on outer periphery of the first rotating shaft.

3. The handheld intelligent electronic fountain device according to claim 2, wherein the ejection tube is vertically arranged vertically relative to the first material guiding tube.

4. The handheld intelligent electronic fountain device according to claim 2, wherein the material guiding component further comprises a second material guiding tube and a second rotating shaft, and the second material guiding tube is rotatably connected to the second rotating shaft;

an outer periphery of the second rotating shaft is provided with a third threaded portion, and the third threaded portion is arranged in the second material guiding tube;

an end of the second rotating shaft away from the third threaded portion is spline-connected with a second transmission gear;

the second transmission gear has a first working mode and a second working mode;

wherein in the first working mode, the first transmission gear is separated from the second transmission gear;

wherein in the second working mode, the first transmission gear meshes with the second transmission gear.

5. The handheld intelligent electronic fountain device according to claim 4, wherein the material guiding component further comprises a top ring, Which is fixedly arranged on a surface of the second transmission gear close to the retaining ring;

slanting blocks are arranged on circumference of the second rotating shaft, and the slanting block has two triangular sides and an arc-shaped curved surface, and the arc-shaped curved surface is located between the two triangular sides;

the arc-shaped curved surface has two lowest points and a first highest point;

an inner wall of the second transmission gear is provided with a stepped hole, and a ball stud is slidably connected to the stepped hole, a non-ball end of the ball stud is fixedly connected with a reset compression spring, and an end of the reset compression spring away from the ball stud is fixedly connected with a fixing ring, the fixing ring is fixedly arranged at bottom of the stepped hole.

6. The handheld intelligent electronic fountain device according to claim 4, wherein a control post is fixedly connected to center of the second transmission gear close to the top ring.

7. The handheld intelligent electronic fountain device according to claim 1, wherein an end of the first rotating shaft close to the second threaded portion is threadedly connected with a bolt, and an outer end surface of the bolt is provided with either a slot or a cross groove.

8. The handheld intelligent electronic fountain device according to claim 1, wherein the air supply component comprises a fan, and the fan is arranged at an end of the ejection tube away from a discharge direction of the consumables.

9. The handheld intelligent electronic fountain device according to claim 1, wherein the power component comprises a drive motor and a third transmission gear, the third transmission gear is fixedly connected to an output shaft of the drive motor, and the third transmission gear meshes with the first transmission gear.

10. The handheld intelligent electronic fountain device according to claim 1, wherein rechargeable batteries are arranged inside the housing.

* * * * *